US006026994A

United States Patent [19]

Rigel

[11] Patent Number: 6,026,994

[45] Date of Patent: Feb. 22, 2000

[54] SPOUT ASSEMBLIES FOR BOTTLES

[76] Inventor: Doron Rigel, 15 Sanhedrin Street, 62916 Tel Aviv, Israel

[21] Appl. No.: 09/128,549

[22] Filed: Aug. 4, 1998

[51] Int. Cl.[7] ..... B67D 3/00

[52] U.S. Cl. ..... 222/538; 222/478; 222/527; 222/539; 222/566; 222/567; 222/569

[58] Field of Search ..... 222/478, 527, 222/538, 539, 566–570

[56] References Cited

U.S. PATENT DOCUMENTS

| | | | |
|---|---|---|---|
| 2,684,181 | 7/1954 | Neuner | 222/538 |
| 3,132,776 | 5/1964 | Wasserberg | 222/539 |
| 3,221,935 | 12/1965 | Shurtleff et al. | 222/538 |
| 3,372,846 | 3/1968 | Berkus | 222/538 |
| 5,397,027 | 3/1995 | Koch et al. | 222/1 |

*Primary Examiner*—Steven O. Douglas
*Assistant Examiner*—Timothy L. Maust
*Attorney, Agent, or Firm*—Benjamin J. Barish

[57] ABSTRACT

A sleeve fixedly receivable within the bottle neck, and a spout extending through the sleeve and movable therein to an extended position projecting outwardly of the bottle neck to facilitate pouring contents from the bottle or to a retracted position disposed within the neck when closed by the bottle cap.

18 Claims, 2 Drawing Sheets

SPOUT ASSEMBLIES FOR BOTTLES

FIELD AND BACKGROUND OF THE INVENTION

The present invention relates to a spout assembly for a bottle, and particularly to a spout assembly for bottles which may be capped without removing the spout assembly.

Many different types of bottles are provided with pouring spouts to facilitate pouring the bottle contents out of the bottle. The bottle contents may be a liquid, e.g., an alcoholic drink, but may also be pourable granular material, e.g., salt, flour or the like. Where the bottle is provided with a cap, it is generally necessary to remove the spout before the cap can be applied. This is inconvenient, since it requires extra manipulations in removing the spout to apply the cap, and in reapplying the spout after the cap has been removed. Moreover, the removed spout requires a suitable place for holding it until again needed. Further, removing the spout may also result in its misplacement when the spout is again needed.

OBJECTS AND BRIEF SUMMARY OF THE INVENTION

An object of the present invention is to provide a spout assembly which does not have to be removed from the bottle when the bottle is to be capped.

Another object of the invention is to provide a spout assembly which can be produced in volume and at low cost.

According to a broad aspect of the present invention, there is provided a spout assembly for a bottle including a neck for pouring the bottle contents, and a cap closing the neck, comprising: a sleeve fixedly receivable within the bottle neck; and a spout extending through the sleeve and movable therein to an extended position projecting outwardly of the bottle neck to facilitate pouring contents from the bottle, and to a retracted position disposed within the neck when closed by the cap. The outer surface of the spout is formed with an annular rib limiting against an inner rib formed in the sleeve in the extended position of the spout.

According to further features in the described preferred embodiment, the outer surface of the sleeve is cylindrical and is formed with a plurality of annular ribs axially-spaced from each other and having an outer diameter substantially equal to the inner diameter of the bottle neck, for fixing the sleeve within the neck. In addition, the outer end of the sleeve is formed with a flange of larger outer diameter than the ribs to limit against the outer surface of the neck when the sleeve is fixed within the neck. Also, the outer surface of the spout is formed with an annular rib limitting against an inner rib formed in the sleeve in the extended position of the spout.

According to still further features in the described preferred embodiment, the spout includes a first passageway for pouring the bottle contents, and a second passageway providing an air return into the bottle. The first passageway is formed within the spout, and the second passageway is formed on the outer surface of the spout. In addition, the spout further includes a tube communicating with the second passageway and extending inwardly of the spout into the bottle interior for conducting the air into the interior of the bottle.

As will be described more particularly below, a spout assembly constructed in accordance with the foregoing features does not require removing the spout when the bottle is to be capped since the spout is movable to a retracted position within the bottle neck when the cap is to be applied.

According to additional features in the described preferred embodiment, the spout assembly further includes a coil spring normally urging the spout to its extended position, but compressable to permit moving the spout to its retracted position. With this feature, the spout is automatically extended when the cap is removed, and is automatically retracted when the cap is applied to the bottle.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE ILLUSTRATED PREFERRED EMBODIMENT

Figure 5:
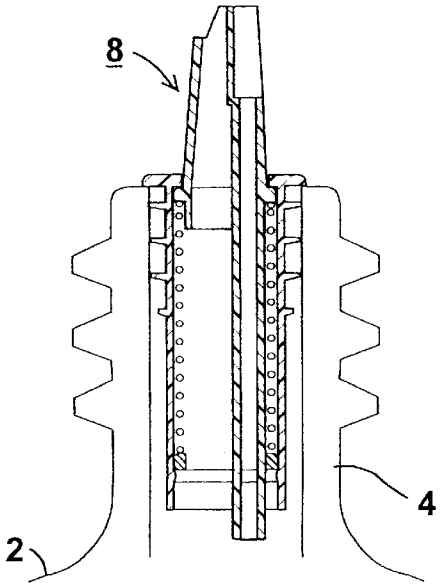
FIG. 5 illustrates the spout assembly of FIGS. 1 and 2 received within a bottle neck when the cap is removed and the spout is automatically extended to its operative position.
Figure 6:
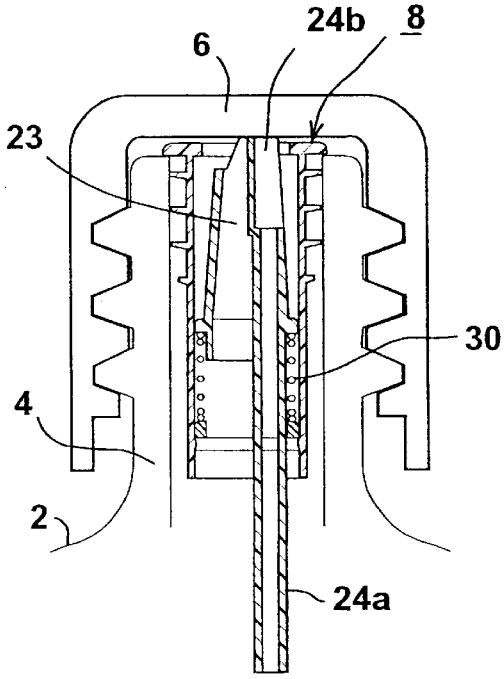
FIG. 6 illustrates the spout assembly when the cap is applied and the spout is retracted to its non-operative position.

With reference first to FIGS. 5 and 6, there is illustrated a bottle, generally designated 2, formed with a neck 4 which is adpated to be closed by a cap 6 (FIG. 6). A spout assembly constructed in accordance with the present invention, and generally designated 8 in FIGS. 5 and 6, is fixedly received within neck 4 of the bottle 2, so that it does not have to be removed in order to apply the cap 6. Thus, when cap 6 is applied, the spout within the assembly 8 is automatically moved to a retracted position, as shown in FIG. 6; and when the cap is removed, the spout automatically moves to an extended position, as shown in FIG. 5, to enable it to be used for pouring out the bottle contents.

Figure 1:
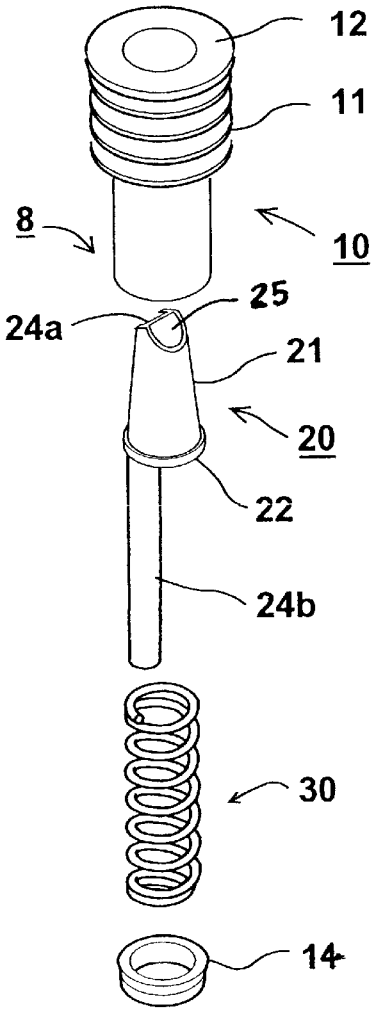
FIG. 1 is an exploded perpspective view illustrating one form of spout assembly constructed in accordance with the present invention as applied to the neck of a bottle which may be capped, as shown in FIGS. 5 and 6.
Figure 2:
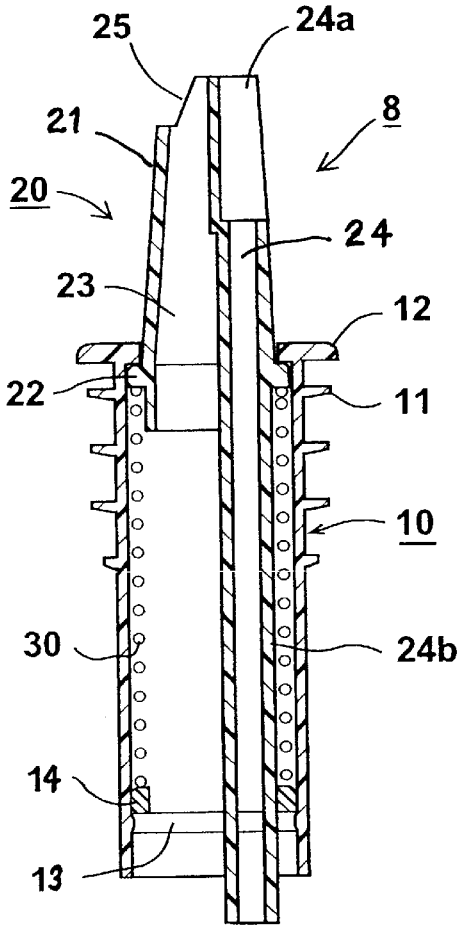
FIG. 2 is a longitudinal sectional view illustrating the spout assembly of FIG. 1.
Figure 3:
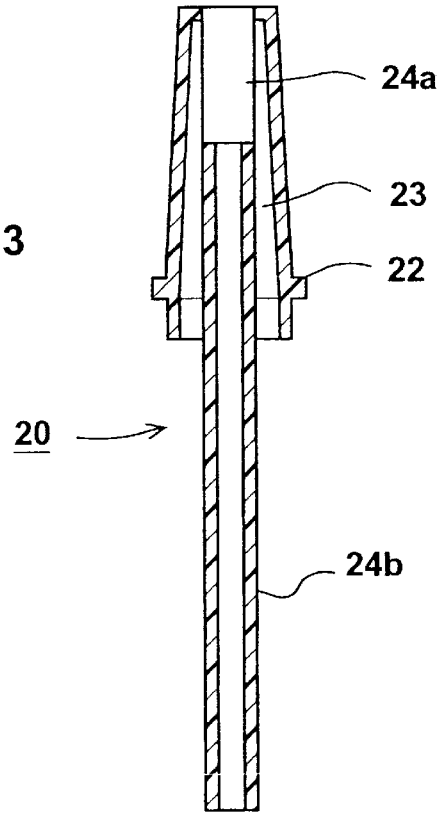
FIG. 3 is a sectional view illustrating only the spout in the assembly of FIGS. 1 and 2.
Figure 4:
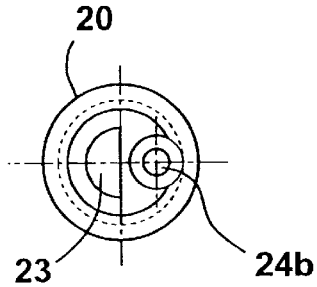
FIG. 4 is a top plan view illustrating the spout of FIG. 3.

As shown particularly in FIGS. 1 and 2, spout assembly 8 includes a cylindrical sleeve, generally designated 10, fixedly receivable within the bottle neck 4; a spout, generally designated 20, extending through the sleeve and movable therein to an extended position projecting outwardly of the bottle neck (FIG. 5) to facilitate pouring the contents from the bottle, and to a retracted position disposed within the neck when closed by the cap 6 (FIG. 6); and a coiled spring, generally designated 30, normally urging the spout 20 to its extended position but compressible to permit moving the spout to its retracted position.

Cylindrical sleeve 10 is formed, at its outer end (with respect to bottle 2) with a plurality of annular ribs 11 axially spaced from each other and having an outer diameter substantially equal to the inner diameter of the bottle neck 4, for fixing the sleeve within the neck. Sleeve 10 is further formed with a flange 12 of larger outer diameter than the ribs 11 to limit against the outer surface of the neck 4 when the sleeve is fixed within the neck. The opposite end of sleeve 10 (i.e., the end facing the interior of the bottle) is formed on its inner surface with an annular rib 13 (FIG. 2) adapted to receive a snap-ring 14, which ring serves as one end of an abuttment for the coil spring 30. The opposite end (outer end with respect to the interior of the bottle 2) of the coil spring 30 abuts against the spout 20, as described below.

Spout 20, as briefly described below, is receivable within cylindrical sleeve 10, and is movable to an extended position under the influence of spring 30 when cap 6 is removed (FIG. 5), or to a retracted position (FIG. 6) when the cap is applied. The outer end of spout 20 (i.e., with respect to the interior of bottle 2) is formed with an outer conical surface, as shown at 21, to facilitate its movement within the cylindrical sleeve 10. The inner end of spout 20 is formed with an outer annular rib 22 which serves as an abuttment for the outer end of the coil spring 30. The latter spring normally urges rib 22 of spout 20 against the inner surface of flange 12 of the sleeve 10, to define the extended position of the spout.

Spout 20 is formed with two passageways, namely: a first passageway 23 for the liquid (or other pourable material) to be poured from the bottle 2; and an air passageway 24 for returning air to the interior of the bottle when its contents are being poured. The air passageway 24 includes a rectangular recess 24*a* formed in the outer surface of the outer end of spout 20 and extending axially a short distance thereof, and a tube 24 communicating with recess 24*a* and of a length to project inwardly of the inner end of sleeve 10.

As shown particularly in FIG. 2, the outer end 25 of spout 20 is cut at a bias (e.g., about 50 degrees) on the side thereof occupied by the contents-flow passageway 23, i.e., opposite to the air-inlet passageway 24, to facilitate pouring out the contents from the bottle while permitting air to pass into the bottle.

The manner of using the spout assembly illustrated in the drawings will be apparent from the above description.

Thus, the spout 20 is passed through the interior of the sleeve 10 until rib 22 of the spout abuts the inner surface of flange 12 of the sleeve. Coil spring 30 is inserted into the sleeve such that the upper end of the spring abuts annular rib 22 of the spout 20. Finally, snap-ring 14 is inserted into the sleeve 10 to engage the opposite end of spring 30.

It will thus be seen that spring 30 normally urges the spout 20 to the outermost or extended position of the spout as illustrated in FIGS. 2 and 5.

The spout assembly 8 is then inserted into the bottle neck 4 with the ribs 11 of the sleeve 10 firmly engaging the interior of the bottle neck to fix the sleeve therein, and with the inner surface of sleeve flange 12 engaging the outer tip of the bottle neck.

It will thus be seen that when cap 6 of the bottle is removed, as shown in FIG. 5, the spout 20 is automatically moved to its extended position by spring 30 to enable the spout to be used for pouring out contents of the bottle via passageway 23 of the spout, while air is returned into the interior of the bottle via passageway 24 defined by recess 24*a* and tube 24*b*. When cap 6 is applied to the bottle neck 4, spout 20 is automatically moved by this application of the cap to the retracted position, which is permitted by the compression of spring 30, as shown in FIG. 6. Accordingly, when the cap is to be applied to a bottle containing the spout assembly, it is not necessary to remove the spout assembly as in conventional spout constructions.

Sleeve 10 and spout 20 of the illustrated assembly are preferably made of a plastic material. Spring 30 may be made of metal or plastic.

While the invention has been described with respect to one preferred embodiment, it will be appreciated that this is set forth merely for purposes of example, and that many other variations, modifications and other applications of the invention may be made.

What is claimed is:

1. A spout assembly adapted to be fixedly received within a bottle including a neck for pouring the bottle contents, and a cap closing the neck, comprising:

a sleeve fixedly receivable within the bottle neck;

and a spout extending through said sleeve and movable therein to an extended position projecting outwardly of the bottle neck to facilitate pouring contents from the bottle, and to a retracted position disposed within the neck when closed by the cap;

the outer surface of said spout being formed with an annular rib limiting against an inner rib formed in the sleeve in the extended position of the spout.

2. The spout assembly according to claim 1, wherein the outer surface of said sleeve is cylindrical and is formed with a plurality of annular ribs axially-spaced from each other and having an outer diameter substantially equal to the inner diameter of the bottle neck, for fixing the sleeve within the neck.

3. The spout assembly according to claim 2, wherein the outer end of said sleeve is formed with a flange of larger outer diameter than said ribs to limit against the outer surface of the neck when the sleeve is fixed within the neck.

4. The spout assembly according to claim 1, wherein said assembly further includes a coil spring normally urging the spout to its extended position, but compressable to permit moving the spout to its retracted position.

5. The spout assembly according to claim 1, wherein said spout includes a first passageway for pouring the bottle contents, and a second passageway providing an air return into the bottle.

6. The spout assembly according to claim 5, wherein said first passageway is formed within the spout, and said second passageway is formed on the outer surface of the spout.

7. The spout assembly according to claim 6, wherein said spout further includes a tube communicating with said second passageway and extending inwardly of the spout into the bottle interior for conducting the air into the interior of the bottle.

8. The spout assembly according to claim 6, wherein said second passageway includes an axially-extending recess formed in the outer surface of the spout.

9. The spout assembly according to claim 8, wherein the outer tip of the spout is cut at a bias on the side of the spout opposite to that formed with said axially-extending recess.

10. A spout assembly adapted to be fixedly received within a bottle including a neck for pouring the bottle contents, and a cap closing the neck, comprising:

a sleeve fixedly receivable within the bottle neck;

a spout extending through said sleeve and movable therein to an extended position projecting outwardly of the bottle neck to facilitate pouring contents from the bottle, and to a retracted position disposed within the neck when closed by the cap;

and a spring urging the spout to its extended position but deformable to permit the spout to be moved to its retractive position;

said spout being formed with a first passageway for pouring the bottle contents, and a second passageway providing an air return into the bottle.

11. The spout assembly according to claim 10, wherein said spring is a coil spring interposed between an annular shoulder on the inner surface of the sleeve, and an annular abuttment on said spout.

12. The spout assembly according to claim 11, wherein said annular shoulder on the inner surface of the sleeve is defined by a snap-ring snappable into an annular groove in the inner surface of the sleeve after the spout has been assembled within the sleeve.

13. The spout assembly according to claim 11, wherein said annular abuttment on the spout is the inner end of the spout to face the interior of the bottle when the spout assembly is applied thereto.

14. The spout assembly according to claim 13, wherein the inner end of the spout, facing inwardly of the bottle, is formed on its outer surface with an annular rib limiting against an annular rib formed by the inner surface of the sleeve in the extended position of the spout.

15. The spout assembly according to claim 10, wherein the outer surface of said sleeve is cylindrical and is formed with a plurality of annular ribs axially-spaced from each other and having an outer diameter substantially equal to the inner diameter of the bottle neck, for fixing the sleeve within the neck.

16. The spout assembly according to claim 10, wherein said first passageway is formed within the spout, and said second passageway is formed on the outer surface of the spout.

17. The spout assembly according to claim 16, wherein said spout is formed with a tube communicating with said second passageway and extending inwardly of the spout into the bottle interior for conducting the air into the interior of the bottle.

18. The spout assembly according to claim 17, wherein said second passageway includes an axially-extending recess formed in the outer surface of the spout, and the outer tip of the spout is cut at a bias to the side of the spout opposite to that formed with said axially-extending recess.

* * * * *